United States Patent [19]

Volkers

[11] 3,995,590

[45] Dec. 7, 1976

[54] BLENDING CHAMBER FOR ELECTROSTATIC PROCESSORS

[75] Inventor: Stewart W. Volkers, Williamson, N.Y.

[73] Assignee: Xerox Corporation, Stamford, Conn.

[22] Filed: Apr. 28, 1975

[21] Appl. No.: 572,371

[52] U.S. Cl. ..... 118/658; 118/312; 118/602; 118/612; 259/30; 259/89

[51] Int. Cl.[2] ..... G03G 15/08

[58] Field of Search ..... 118/637, 602, 612, 312; 355/3 DD, 15; 427/242; 259/3, 14, 30, 81 R, 89

[56] References Cited

UNITED STATES PATENTS

| | | | |
|---|---|---|---|
| 186,120 | 1/1877 | Davis et al. | 259/30 |
| 3,122,455 | 2/1964 | Grimm et al. | 118/312 |
| 3,381,944 | 5/1968 | Clary | 259/3 |
| 3,724,422 | 4/1973 | Latone et al. | 118/637 |
| 3,846,271 | 11/1974 | Singleton | 259/89 |
| 3,881,446 | 5/1975 | Kurita et al. | 118/637 |

*Primary Examiner*—Mervin Stein
*Assistant Examiner*—Douglas Salser

[57] ABSTRACT

A blender for blending a mixture of flowable materials, such as the carrier and toner components of a developer for an electrostatic processor, comprises a rotatable chamber having radially angulated passageways extending through its periphery for guiding the materials into and out of the chamber. The passageways are open, but the mixture tends to at least temporally dwell in the chamber and is, therefore, subjected to a tumbling action, because the radial angulation of the passageways exceeds the angle of repose of the mixture. Continuous and discontinuous blenders embodying these principles are disclosed.

6 Claims, 3 Drawing Figures

BLENDING CHAMBER FOR ELECTROSTATIC PROCESSORS

BACKGROUND OF THE INVENTION

This invention relates to the blending of flowable materials and, more particularly, to the blending of carrier and toner particles in development systems for continuous electrostatic processors.

In a conventional electrostatic printing process of the type disclosed in Carlson U.S. Pat. No. 2,297,691 on "Electrophotography", a uniformly charged photoreceptor is selectively discharged in an imagewise configuration to provide a latent electrostatic image which is then developed through the application of a finely divided, resinous, electroscopic marking material, called "toner". That process has enjoyed outstanding commercial success, especially in continuous copiers and duplicators (hereinafter collectively referred to as "processors") wherein the toner is applied to the latent image on the fly as the photoconductor moves through a development zone. Nevertheless, substantial effort and expense are still being devoted to the perfection of various aspects of the process, including the development step.

Generally, the toner is transported from a sump to the development zone in triboelectric combination with a relatively coarse, granular "carrier" material, such as glass, sand or ferrite beads. Indeed, that mixture is what is commonly referred to as "developer". During the development process, toner particles are electrostatically stripped from the carrier particles, thereby leaving a residue of partially denuded carrier.

In continuous processors, the partially denuded carrier is returned to the sump for recirculation and fresh toner is manually or automatically added thereto from time-to-time to maintain the toner concentration of the developer at a suitably high level. Ideally, of course, the additional or fresh toner is rapidly blended in with the recirculating developer and brought into appropriate triboelectric relationship with the carrier. Experience has, however, demonstrated that that is difficult to accomplish.

SUMMARY OF THE INVENTION

Accordingly, an important object of this invention is to provide a relatively efficient blender for use in continuous electrostatic processors to rapidly blend fresh toner in with recirculating developer.

Another object of the present invention is to provide a blender which not only does that, but which also effectively increases the developer life.

Taking an even broader view of the problem, a general object of this invention is to provide a relatively efficient blender for accepting raw materials flowing from one or more locations and dispensing those materials in blended form toward another location. A somewhat more detailed, related object is to provide a blender of the foregoing type which is capable of accepting and maintaining more or less steady flows of raw and blended materials, respectively.

A further object of the present invention is to provide a relatively efficient, inexpensive and reliable blender having the aforementioned characteristics.

To achieve these and other aims of this invention, the continuous and discontinuous blenders disclosed herein are each characterized by having a rotatable chamber with radially angulated passageways extending through its periphery. The components of a mixture (i.e., the carrier and toner components of a developer for an electrostatic processor) are guided into and out of the chamber in unblended and blended form, respectively, by the passageways. The passageways are open, but the mixture tends to at least temporally dwell in the chamber and is, therefore, subjected to a tumbling action, because the radial angulation of the passageways exceeds the angle of repose of the developer.

BRIEF DESCRIPTION OF THE DRAWINGS

Still further objects and advantages of this invention will become apparent when the following detailed description is read in conjunction with the attached drawings, in which.

DETAILED DESCRIPTION OF THE ILLUSTRATED EMBODIMENTS

While the invention is described hereinafter in some detail with specific reference to certain illustrated embodiments, it is to be understood that there is no intent to limit it to those embodiments. On the contrary, the aim is to cover all modifications, alternatives and equivalents falling within the spirit and scope of the invention as defined by the appended claims.

Figure 1:
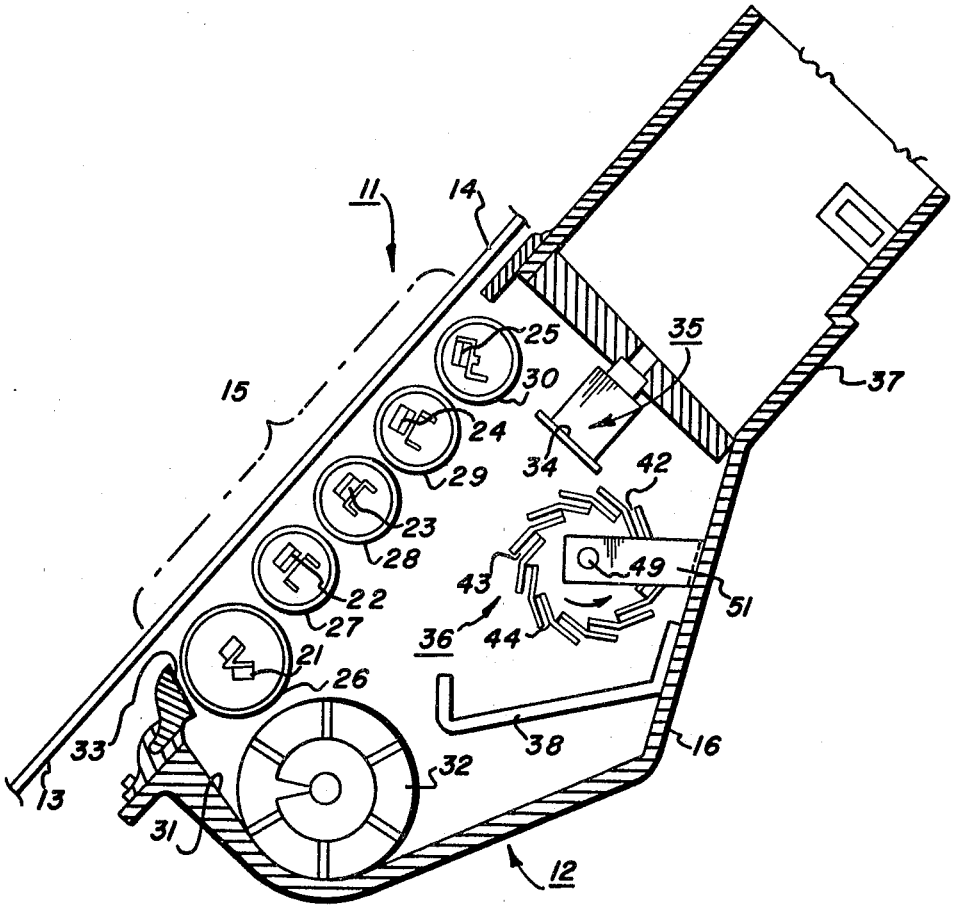
FIG. 1 is a fragmentary elevational view, partially in section, of an electrostatic processor having a development system including a continuous blender constructed in accordance with the present invention.

Turning now to the drawings, and at this point especially to FIG. 1, it will be seen that there is a continuous electrostatic copier 11 (shown only in relevant part) having a magnetic brush development system 12 for developing latent electrostatic images carried by a photosensitive surface 13 of a flexible belt 14 on the fly - viz., as the belt 14 moves through a development zone 15.

To accomplish that, the development system 12 comprises a housing 16 which opens outwardly toward the photosensitive surface 13 to define the development zone 15, together with a plurality of stationary permanent magnets 21–25 which are supported with separate, non-magnetic, sleeve-like rolls 26–30, respectively. The rolls 26–30 are journalled in the housing 16 for rotation about substantially parallel axes at spaced intervals along the length of the development zone 15, and their surfaces are offset from the photosensitive surface 13 by narrow gaps. Full field development is assured because each of the magnets 21–25 and each of the rolls 26–30 extends across substantially the full width of the development zone 15.

In operation, developer (e.g., toner particles triboelectrically attracted to ferrite carrier particles) travels in a more or less steady stream from a sump 31 in the lower reaches of the housing 16, upwardly through the development zone 15, and then back to a sump 31. To that end, provision (not shown) is made for rotating the rolls 26–30 in a direction (clockwise as viewed) selected to advance the developer through the gaps between the rolls 26–30 and the photosensitive surface 13. The developer in those gaps columniates under the influence of the composite magnetic field supplied by the magnets 21–25, thereby forming bristle-like stacks or streamers of developer which brush against the photosensitive surface 13. If a latent image happens to be present, toner particles are electrostatically stripped from the carrier particles of the columniated developer and transferred to the photosensitive surface 13 to develop the image.

More particularly, as shown there is an elongated paddlewheel 32 which rotates (clockwise as viewed) to transport developer from the sump 31 to a pick-up area 33 immediately below the development zone 15. As will be appreciated, the paddlewheel 32 agitates the developer, thereby increasing the triboelectric attraction between the carrier and toner particles. Developer entering the pick-up area 33 is magnetically entrained on the lower roll 26 and then sequentially by the other rolls 27–30 so that it is serially transported through the gaps between the rolls 26–30 and the photosensitive surface 13. At the upper end of the development zone 15, the developer escapes from the magnetic field of the magnets 21–25 as it passes over the top of the upper roll 30. The developer then drops on an inclined slide 34 which guides it through a retoning station 35 and then to a blender 36. From there, the developer drops back to the sump 31.

Typically, of course, there is a more or less conventional toner dispenser 37 mounted above the retoning station 35 so that fresh toner may be added to the recirculating developer from time-to-time, thereby maintaining its toner concentration at a suitably high level. Furthermore, in this instance, there also is a screen 38 positioned between the blender 36 and the sump 31 for removing lumps and other accumulated debris from the developer.

In accordance with this invention, the blender 36 comprises a rotatable chamber 41 for gently tumbling the developer enroute from the retoning station 35 to the sump 31. The tumbling action not only blends any fresh toner in with the balance of the developer, but also promotes the proper triboelectric charging of the carrier and toner particles.

To carry out the invention, the chamber 41 is mounted with its axis of rotation generally parallel to the rolls 26–30. Moreover, the periphery of the chamber 41 is formed to define a plurality of axially elongated, radially angulated, channel-like overlapping 42–44 for guiding the developer into and out of the chamber 41. Importantly, the developer tends to temporally dwell in the chamber 41 because the minimum radial angulation of each of the passageways 42–44 (i.e., the complement of the largest line of sight angle that the passageway makes with a radius extending from the axis of rotation of the chamber 41 to the inner end of the passageway) is selected to exceed the angle of repose of the developer. The angle of repose of any material is the angle with the horizontal at which the material will stand when piled. As a practical matter that means that each of the passageways 42–44 is radially angulated by at least 25°–40° or so, depending on the composition of and the normal operating environment for the developer. It should, however, be understood that even greater amounts of radial angulation are tolerable and, in fact, usually desirable inasmuch as the average amount of time the developer dwells in the chamber 41 increases as a direct function of any additional angulation.

Figure 2:
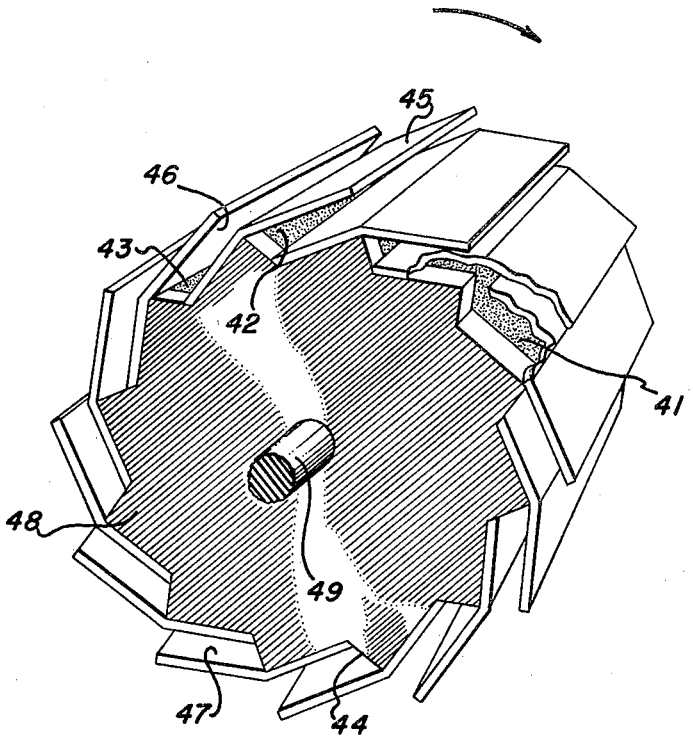
FIG. 2 is an enlarged perspective view of the blender shown in FIG. 1.

As will be apparent, the blender 36 is compatible with a more or less continuous flow of developer from the retoning station 35 to the sump 31. To that end, as best shown in FIG. 2, it comprises a plurality of generally V-shaped ribs 45–47 which are bridged between a pair of end plates 48 (only one can be seen) at regular angular intervals about a drive shaft 49. The drive shaft 49 is pinned or otherwise secured to the end plates 48 and is driven in operation to rotate the chamber 41 in a predetermined direction (i.e., counterclockwise as shown in FIG. 1). The end plates 48, on the other hand, have matching stepped peripheries for supporting the ribs 45–47 in overlapping relationship. That is, each of the ribs 45–47 has one arm anchored between the end plates 48 and its other arm freely extending in a contra-rotational or clockwise direction into overlying relationship with the anchored or forward-most arm of the next adjacent rib, thereby defining the channel-like passageways 42–44.

Returning for a moment to FIG. 1, it will be seen that the blender 36 is mounted on the housing 16 by a bracket 51. The axis of the shaft 49 (i.e., the axis of rotation of the chamber 41) is generally parallel to but slightly offset to the rear of the path the developer takes upon leaving the retoning station 35 so that there is a smooth flow of developer into the chamber 41 as successive ones of the passageways 42–44 cut across the flow path.

Figure 3:
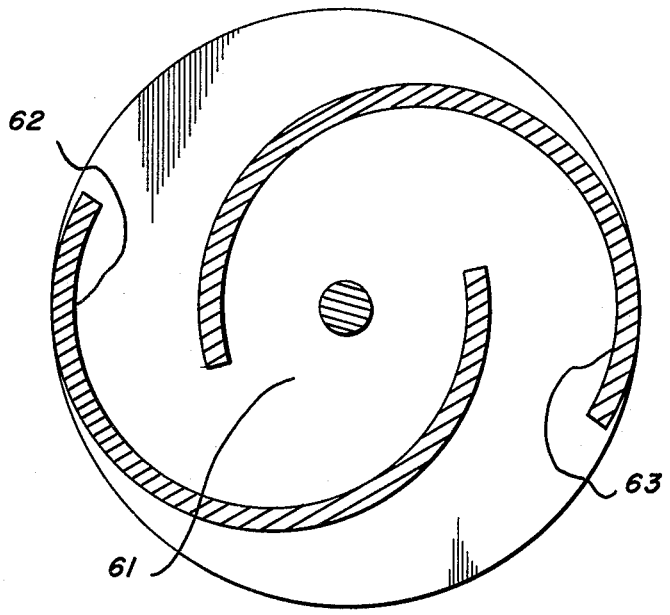
FIG. 3 is a perspective view of a discontinuous blender embodying this invention.

Turning to FIG. 3, it will be seen that the principles of this invention are also applicable to discontinuous blenders. That is, as shown, there are a pair of axially elongated, arcuate sections 62 and 63 which are eccentrically mounted in overalpping relationship within a rotatable chamber 61. To carry out this aspect of the invention, the offset between the centers of the arcuate sections 62 and 63 and the degree of overlap therebetween are selected so that the gravitational and other forces acting on the material cause the blender to operate in a loading mode in response to rotation of the chamber 61 in one direction (clockwise as shown) and in a discharge mode in response to rotation of the chamber 61 in the opposite or counterclockwise direction. In other words, the radial angulation of the passageways between the arcuate sections 62 and 63 is selected to exceed the angle of repose of the developer or other material to be blended when measured with the chamber 61 rotating in the loading or clockwise direction, but not when measured with the chamber 61 rotating in a counterclockwise direction.

SUMMARY

In view of the foregoing, it should now be understood that the present invention provides relatively simple and reliable, continuous and discontinuous blenders for blending mixtures of flowable materials. Moreover, it should be appreciated that the continuous blender of this invention may be used to special advantage in the development system of a continuous electrostatic processor since it not only improves the blending of the carrier and toner components of the developer for the processor but also aids in establishing the proper triboelectric relationship between the carrier and toner particles. Additionally, it will be apparent that when the blender is used in such a processor, the blending chamber provides supplemental storage for developer, thereby increasing the developer capacity of the development system which, in turn, increases the life of the developer.

What is claimed is:

1. A blender for blending a mixture of flowable materials, said mixture having a predetermined angle of repose; said blender comprising a rotatable chamber having a periphery with a plurality of radially angulated passageways extending therethrough to guide the materials of the mixture into and out of said chamber; the radial angulation of said passageways exceeding the angle of repose of said mixture, said chamber comprising a plurality of generally V-shaped ribs bridged between a pair of opposed end plates at regular angular intervals about said axis of rotation, each of said ribs having one arm anchored to said end plates and another arm freely extending into overlapping spaced relationship with the anchored arm of the next adjacent rib to thereby define said passageways whereby said mixture tends to at least temporarily dwell in said chamber.

2. The blender of claim 1 wherein said passageways are radially angulated in a predetermined direction and said chamber is rotated in the opposite direction to thereby accomodate a substantially continuous flow of materials into and out of said chamber.

3. The blender of claim 1 wherein the radial angulation passageways of said passageways is selected to cause the blender to operate in a loading mode when said chamber is rotated in one direction and in a discharge mode when said chamber is rotated in the opposite direction.

4. In a continuous electrostatic processor having a development system for developing latent electrostatic images on the fly as a photosensitive surface carrying said images moves through a development zone; said system including means for circulating a developer having a predetermined angle of repose and containing triboelectrically charged carrier and toner particles along a predetermined path from a sump, through said development zone, and then back to said sump; the improvement comprising a blender for tumbling the circulating developer to blend the carrier and toner particles and to promote the triboelectric charging thereof; said blender including a chamber mounted for rotation about an axis generally parallel to and slightly offset from said path, said chamber having a periphery with a plurality of axially elongated, radially angulated passageways extending therethrough whereby developer is guided into and out of said chamber by successuve ones of said passageways, the radial angulation of said passageways exceeding the angle of repose of said developer whereby the developer tends to temporally dwell in said chamber.

5. The processor of claim 4 wherein said chamber comprises a plurality of generally V-shaped ribs bridged between a pair of opposed end plates at regular angular intervals about said axis of rotation, each of said ribs having one arm anchored to said end plates and another arm freely extending into overlapping spaced relationship with the anchored arm of the next adjacent rib to thereby define said passageways.

6. The processor of claim 4 further including a retoning station positioned along said path for adding fresh toner to said developer from time-to-time, said blender being disposed between said retoning station and said sump to blend any fresh toner in with the developer returning to the sump.

* * * * *